United States Patent [19]

Deutsch

[11] Patent Number: 4,941,445

[45] Date of Patent: Jul. 17, 1990

[54] ELECTRONIC POSITION SENSOR ASSEMBLY AND ENGINE CONTROL SYSTEM

[75] Inventor: Robert W. Deutsch, Sugar Grove, Ill.

[73] Assignee: Motorola, Inc., Schaumburg, Ill.

[21] Appl. No.: 431,721

[22] Filed: Nov. 2, 1989

Related U.S. Application Data

[63] Continuation of Ser. No. 194,237, May 16, 1988, abandoned.

[51] Int. Cl.[5] ..... F02D 41/22; F02P 5/15; F02P 11/00

[52] U.S. Cl. ..... 123/414; 123/479; 123/630; 123/643

[58] Field of Search ..... 123/414, 643, 416, 417, 123/479, 630; 73/116, 117.3; 324/178, 208

[56] References Cited

U.S. PATENT DOCUMENTS

| | | | |
|---|---|---|---|
| 4,168,682 | 9/1979 | Gartner et al. | 123/416 |
| 4,231,332 | 11/1980 | Wrathall | 123/416 |
| 4,241,708 | 12/1980 | Javeri | 123/418 |
| 4,250,846 | 2/1981 | Menard | 123/414 |
| 4,338,813 | 7/1982 | Hunninghaus et al. | 73/116 |
| 4,338,903 | 7/1982 | Bolinger | 123/476 |
| 4,378,004 | 3/1983 | Petrie | 123/643 |
| 4,385,605 | 5/1983 | Petrie et al. | 123/414 |
| 4,442,822 | 4/1984 | Kondo et al. | 123/414 X |
| 4,553,426 | 11/1985 | Capurka | 73/116 |
| 4,628,269 | 12/1986 | Hunninghaus et al. | 328/120 |
| 4,656,634 | 4/1987 | Lombardi | 371/68 |
| 4,658,786 | 4/1987 | Foss et al. | 123/414 |

FOREIGN PATENT DOCUMENTS

| | | | |
|---|---|---|---|
| 50272 | 3/1985 | Japan | 123/414 |

OTHER PUBLICATIONS

Hitachi Review Article, p. 138, Jun. 1986.
IEEE Spectrum Article, Oct. 1986, pp. 68 and 70.
Advertisement for Motorola New Dual Optointerrupter, no date.

*Primary Examiner*—Tony M. Argenbright
*Attorney, Agent, or Firm*—Phillip H. Melamed

[57] ABSTRACT

An improved electronic position sensor assembly and engine control system is provided in which two sensing elements in a dual sensor provide separate, independent position signals related to multi-cylinder engine cycle position by sensing the angular position of a engine-rotated slotted wheel. The sensing elements provide identical sensing signals shifted from each other by a predetermined angular amount. In response to the simultaneous occurrence of a pulse by both sensing elements, a first reference signal identifying a reference cylinder is provided for controlling electronic distribution of either spark timing and/or fuel injection signals to the various engine cylinders. In response to one of the sensing elements producing a pulse which has a predetermined longer duration than a preceding produced pulse, a second reference signal is produced indicative of top-dead center engine cylinder cycle position for one of the cylinders. In response to detecting a fault in one of the position signals produced by said sensing elements, a switch selects the other of said sensing elements for utilization in producing said second reference signal, and a substitute reference signal means provides a substitute first reference signal. A less expensive and more reliable engine position sensor assembly and engine control system is provided since proper system operation is maintained despite a fault in one of said sensing signals.

61 Claims, 4 Drawing Sheets

ELECTRONIC POSITION SENSOR ASSEMBLY AND ENGINE CONTROL SYSTEM

This is a continuation of application Ser. No. 07/194,237, filed May 16, 1988 and now abandoned.

BACKGROUND OF THE INVENTION

The present invention relates to the field of electronic position sensor assemblies and the use of position sensor signals in a control system. The present invention has particular application to an electronic engine-control system, especially such a system which utilizes electronic spark distribution and/or electronic fuel control signal distribution so as to sequentially provide control signals for the spark occurrence/fuel injection for each cylinder of a multi-cylinder engine.

Prior engine control systems are known in which spark timing occurrence control signals and fuel injection control signals are produced in accordance with engine speed. Typically these control signals are produced in accordance with engine cycle position signals derived by sensing the angular position of projections/-slots on a wheel synchronously rotated by the engine crankshaft. Such wheels are typically referred to as toothed wheels, and reluctance, Hall effect or optical sensors are utilized to sense the angular position of such wheels and thereby provide position signals corresponding to various engine cycle positions.

Typically, three pieces of information are required for engine control systems such as those noted above. First, an accurate high resolution engine speed and position signal is desired This is typically achieved by providing a large number of individual teeth on the periphery of a wheel to be rotated synchronously by the engine crankshaft such that a large number of individual pulses are produced. The repetition rate of these pulses is directly related to engine speed, and pulse time occurrence is indicative of engine cycle position. In addition, in some systems it is necessary to determine the top-dead center (TDC), or other reference, position of the piston in each one of the cylinders of a multiple cylinder engine which is to be controlled by the engine control system. Some prior systems utilize a separate sensing element to provide this top-dead center reference position information by sensing a projection/slot on the rotating wheel (or on a different wheel) which is separate from the large number of individual teeth already being sensed to produce the high resolution engine speed/position signal. In addition, for implementing electronic spark control signal distribution or fuel injection control signal distribution, it is also necessary to provide a reference cylinder identification signal (CID) which identifies one of the multiple cylinders to be controlled as a reference cylinder as opposed to any other of the cylinders. This signal is then used to insure proper initial routing (distribution) of control signals to the various cylinders while the TDC signal may control the timing of the subsequent sequential routing of control signals Some prior systems have utilized three separate sensors to provide the three types of information required for systems such as those described above. Obviously providing three different sensors and three different sets of projections/slots to be sensed is not desirable from either a cost or system complexity point of view. Some prior systems have used missing tooth or special tooth detection systems to provide two of the three pieces of information. U.S. Pat. No. 4,628,269 to Hunninghaus et al. shows a prior system to provide both the high resolution signal and the CID signal. Other systems, such as U.S. Pat. No. 4,338,813 to Hunninghaus et al. and U.S. Pat. No. 4,338,906 to Bolinger, have used two or more sensors to provide TDC and CID signals, but then no high resolution position signals are produced.

What is needed is a sensor system to reliably produce all three types of required signals without using an excessive number of sensors and without using an extensive amount of circuitry or requiring extensive microprocessor calculation time. Preferably such a system should also be able to produce the required high resolution signal and reference signals even if a sensor element fails. Some prior systems, such as U.S. Pat. No. 4,658,786 to Foss et al., take some corrective action in case of a detected fault, but typically the high resolution signal is lost if any sensing element producing that signal fails and/or such systems provide extra circuitry for normally using a different signal as a reference signal and guard against loss of this different reference signal by using, if a fault, the original reference signal. Some systems use simplified coincidence detection circuitry, such as U.S. Pat. No. 4,385,605 to Petrie et al., to provide a reference signal, but in the event of a sensing element failure, no reference signal is provided.

SUMMARY OF THE INVENTION

An object of the present invention is to provide an improved electronic position sensor assembly and an improved electronic engine control system which utilizes a minimum number of position sensor elements while readily providing desired reference signals without excessively complex circuitry or extensive computer programming or operation.

An additional object of the present invention is to provide a control system in which, in response to a fault detected in one of the outputs of a dual sensor assembly, the other output of the assembly is then utilized while proper operation of the control system is maintained.

A further object of the present invention is to provide an improved two-sensing element system which uses coincidence detection to provide a reference signal, and provides a substitute reference signal even if one sensing element fails.

In one embodiment of the present invention there is provided an improved electronic position sensor assembly. This assembly comprises: a wheel rotatably driven about an axis, said wheel having thereon a plurality of projections/slots of at least three different angular widths a, b and c, angular width a being less than angular width b which is less than angular width c; a sensor means positioned fixed with respect to and adjacent said wheel, said sensor having at least first and second sensing elements each independently sensing the passage of each of said projections/slots by the sensing element and producing in response thereto a signal pulse having a duration corresponding to the angular width of said sensed projection/slot; said first and second sensing elements spaced apart by a dimension d corresponding to an angular width which is less than angular width c but more than angular width a and more than angular width b; coincidence means for providing a first reference signal in response to said first and second sensing elements simultaneously producing said signal pulses; and means for providing a second reference signal, in response to one of said sensing elements producing a signal pulse having a predetermined longer duration than the preceding signal pulse produced by that sensing element, whereby information as to the angular position of said wheel is obtained by at least said first and second reference signals.

Preferably, the electronic position sensor assembly described above is utilized in an electronic engine control system wherein at least signal pulses from one of said first and second sensing elements and at least one of the first and second reference signals are utilized to control fuel combustion in cylinders of the engine. This control of fuel combustion can comprise either controlling the spark occurrence which initiates fuel combustion or the amount of or time occurrence of injection of fuel in each cylinder, preferably as determined by fuel injection signals Essentially, the present invention involves providing two sensing signals which differ from each other only in their time occurrence in that one signal directly corresponds to the other signal, except shifted in time occurrence by an amount determined by the spacing between the two sensing elements and the rotational speed of the rotated wheel. In the present system, normally one of the sensing signals is used for primary control of spark timing and/or fuel injection control functions. However, if a fault in this signal is detected, the other signal is then utilized since it directly corresponds to this first signal, except that it is effectively shifted in time occurrence by a fixed angular amount. If necessary, the spark timing and fuel control circuits can be compensated in response to this fault detection so that the end result will be a control system which operates exactly as the control system did prior to the fault detection.

In addition, due to the preferred configuration of projections/slots on the rotating wheel, a reference cylinder identification signal is produced in response to the simultaneous occurrence of pulses by both of the two sensing elements. In response to a detection of a fault in one of the sensing elements, a substitute reference cylinder reference signal means is effectively enabled so as to produce a substitute reference cylinder signal. This signal is then utilized by electronic spark timing distributor and fuel injection distributor circuits to assure that the proper engine cylinders receive, in proper sequence, the spark timing and fuel injection control signals designated for those cylinders.

The present invention utilizes a single sensor having dual sensing elements to provide all three types of the needed information comprising a high resolution engine speed/position signal, a TDC reference signal for each cylinder and a cylinder identification CID reference signal. The present invention also provides for successful engine control operation if a subsequent fault in one of the two sensing signals being produced by the sensing elements is detected. While a majority of the functions of the present invention are preferably implemented by a programmed microprocessor or computer, the critical determination (identification) of the number 1, or reference, cylinder can be readily and inexpensively provided by simple external discrete coincidence circuitry, such as an AND gate. This therefore enables the programmed microprocessor or computer to implement additional engine control functions thereby providing an improved engine control system.

The above functions of the present invention and additional advantages thereof can best be determined by reference to the subsequent description of the present invention.

BRIEF DESCRIPTION OF THE DRAWINGS

For a more complete understanding of the invention, reference should be made to the drawings in which.

DESCRIPTION OF THE PREFERRED EMBODIMENT

Figure 1:
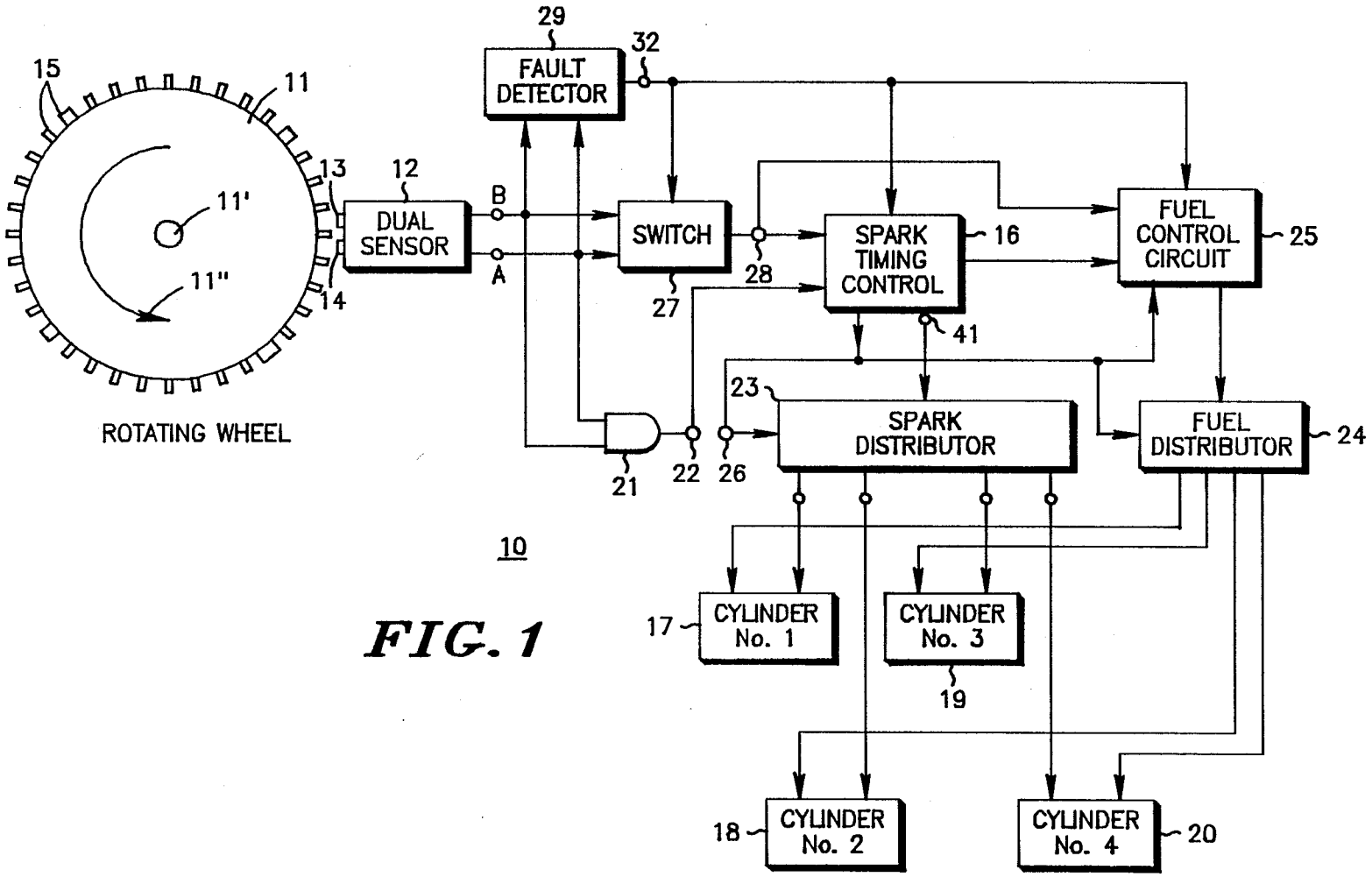
FIG. 1 is a schematic diagram of an engine control system utilizing the present invention.
Figure 2:
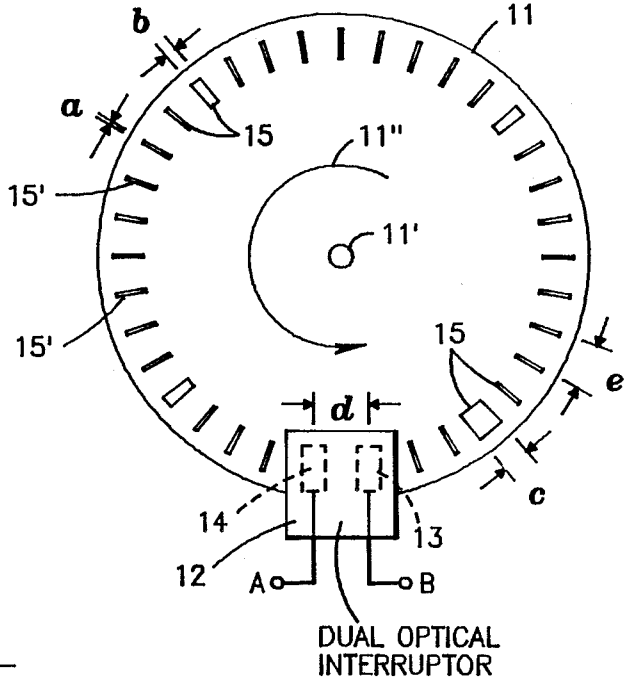
FIG. 2 comprises a detailed schematic diagram of a rotating wheel and dual sensing element sensor illustrated in FIG. 1.

Referring to FIG. 1, an electronic engine control system 10 is illustrated in which spark occurrence signals and fuel injection signals are developed for each cylinder in a multi-cylinder (4 cylinder) engine. The control system includes an electronic position sensor assembly which includes a rotating wheel 11 that is synchronously rotated about an axis 11′ by the crankshaft of an engine (motor) which is not shown. Therefore the wheel 11 is rotated in accordance with engine cylinder cycle position. The term "engine cylinder cycle position" refers to the cyclic position of a piston associated with each cylinder. A dual sensor 12 is provided which has a first sensing element 13 and a second sensing element 14, each of which independently senses the passage of each of a plurality of projections/slots 15 provided on the rotating wheel 11. FIG. 1 only generally indicates the positioning of sensor 12 and wheel 11. FIG. 2 illustrates the preferred positioning and construction of the dual sensor 12 and the rotating wheel 11 which preferably comprises a slotted disk. Preferably the projections/slots 15 comprise straight radially extending slots in the rotating wheel 11. The dual sensor 12 preferably comprises a two sensing element optical interrupter assembly in which a light, not shown in FIG. 2 but positioned behind the rotating wheel 11, selectively actuates the sensor elements 13 and 14 to produce signal pulses in accordance with the passage of the slots 15. Projections on the wheel 11 and a two-sensing element Hall effect sensor could possibly also be used.

Preferably, the slots 15 are provided in at least three different angular widths a, b or c with angular width a being less than angular width b which is less than angular width c. Preferably, the sensing elements 13 and 14 are fixed with respect to each other and spaced apart by a dimension d which corresponds to an angular width which is less than angular width c but more than angular width a and more than angular width b. The sensing elements 13 and 14 produce their respective signal pulses as part of two associated output signals A and B produced at output terminals A and B, respectively.

Preferably, for the four cylinder engine control system 10 shown in FIG. 1, the rotating wheel 11 has three slots having an angular width b corresponding to 3 degrees, one slot having an angular width c corresponding to 7 degrees and thirty-two slots having an angular width a corresponding to 1 degree. A plurality of the 1 degree slots a are provided between each of the slots b and c on the wheel 11. The distance between radial straight leading edges 15' of each of the slots 15 is an angular width spacing e corresponding to 10 degrees, and the rotating wheel 11 is rotated about its axis 11' in an angular direction 11'', as indicated in FIGS. 1 and 2, such that the leading edges 15' of the slots correspond to those edges of the slots which first pass by the sensing elements 13 and 14. It should be noted that the leading edges 15' comprise radially-directed straight edges with respect to axis 11', with each edge 15' being independently sensed by each sensing element 13 and 14. Preferably the spacing d between the sensing elements 13 and 14 corresponds to an angular width of 5 degrees. All angular widths referred to herein are measured with respect to the axis 11' for the rotating wheel 11.

In order for the engine control system 10 to accurately develop spark timing and fuel injection control signals, it is desirable to produce a high resolution and accurate engine speed and cylinder cycle position signal. This is provided by either of signals A or B which are provided by elements 14 and 13 at their respective output terminals indicated in FIGS. 1 and 2 by the same alphabetic designations A and B, respectively. This is because there exists a large number (36) of slots 15 on the rotating wheel 11. It is also desirable to provide information with regard to identifying the top-dead center (TDC) or other reference cycle position of each of the four engine cylinders. This function is provided by the slots b and c having angular widths of substantially greater than the angular width of the slots a with the positioning of the leading edges of each of slots b and c corresponding to the TDC cycle position for an associated one of the 4 engine cylinders, respectively.

In prior engine control systems it is known that circuitry or a microprocessor can determine when a pulse duration of a signal is substantially longer (by at least a factor of 1.5) than an immediately preceding pulse duration of a repetitive signal. U.S. Pat. No. 4,628,269 to Hunninghaus et al. assigned to the same assignee as the present invention, illustrates such a circuit in the context of a missing or extra pulse detector wherein a longer between-pulse duration is distinguished from preceding and following shorter between-pulse durations. Preferably, a programmed microprocessor or computer operating in accordance with the U.S. Pat. No. '269 patent, which structure will be contained within a spark timing control 16 in FIG. 1, will receive one of the signals A or B and provide a TDC reference signal in response to a received signal pulse of signal A or B having a predetermined longer (by at least a factor of 1.5) duration than a preceding-received signal pulse. Thus, pulses having a longer (3 degree or 7 degree) angular width are distinguished from shorter (1 degree) width pulses. This determination will be used by the spark timing control 16 to determine the time occurrence of the top-dead center (TDC) cycle position for each of the four cylinders which are illustrated in FIG. 1 as comprising cylinders 17 through 20. This TDC position determination is used by the control 16 (comprising four TDC pulses per wheel revolution) to time the occurrence of a spark ignition signal provided by the control 16 for each cylinder as is well known in the electronic engine control art.

For many systems it is also necessary to determine an additional reference signal which will enable the engine control system 10 to distinguish between the four TDC reference signal pulses and the angular position of the rotating wheel which corresponds to the occurrence of the TDC position pulse corresponding to the top-dead center position of a specific reference cylinder, such as the No. 1 cylinder corresponding to cylinder 17. This determination is required for electronic spark timing distribution systems (so-called "distributorless" systems) and/or electronic fuel injection distribution systems. System 10 preferably comprises both such systems.

In order to accomplish identification of the No. 1 cylinder, the present invention preferably does not utilize an additional microprocessor program so as to also distinguish between the wider 7 degree reference slot c and the narrower 3 degree shorter reference slots b. This would require too much computing time. Instead, the present invention utilizes external discrete circuitry. This external discrete circuitry is actually extremely inexpensive and simple in that it essentially comprises a coincidence AND gate 21 which receives inputs from each of the terminals A and B and provides an output at a terminal 22. In essence, only when the slot c passes by the dual optical interrupter assembly 12 will pulses be simultaneously produced at the output terminals A and B. This is because the angular width of the slot c (7 degrees) exceeds the angular spacing d (5 degrees) which separates the sensing elements 13 and 14. In such event, the AND gate 21 essentially acts as a coincidence means circuit and will provide a first cylinder identification (CID) reference signal at terminal 22 in response to this condition caused by the first and second sensing elements 13 and 14 simultaneously producing an output signal pulse.

Figure 3:
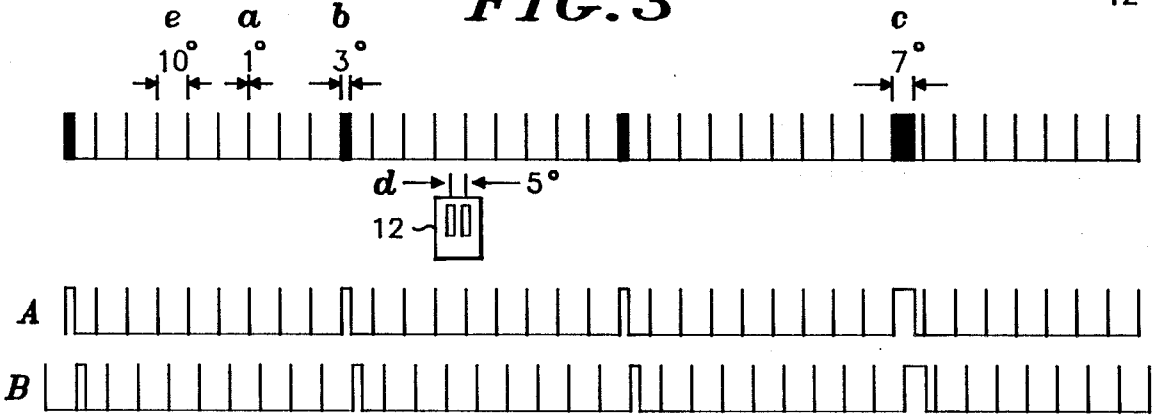
FIG. 3 comprises a linear graphical representation of projections/slots in the rotating wheel and the dual sensor shown in FIG. 2, and the position sensing signals A and B produced in response thereto.

FIG. 3 attempts to linearly illustrate on uniform horizontal time axes the angular position relationships between the slots 15 and output signal pulses which are produced at the terminals A and B. In FIG. 3, the slots 15 are shown as a horizontal linear progression moving in a horizontal direction past the stationary sensor 12. The resultant output pulses provided at the terminals A and B caused by this movement are also shown in FIG. 3 on corresponding horizontal time axes. By a comparison of signal pulses at the output terminals A and B shown in FIG. 3, it is apparent that a positive output of the AND gate 21 will only occur in response to each passage of the reference slot angular width c corresponding to the top-dead center position of the No. 1 reference cylinder, cylinder 17.

The cylinder identification information provided at terminal 22 is provided to the spark timing control 16 for further processing such that it will be utilized by an electronic spark distributor 23 and an electronic fuel injection distributor 24. These electronic distributors essentially receive spark timing occurrence control signals from the spark timing control 16 and fuel injection control signals from a fuel control circuit 25, respectively, and provide these signals, in the proper sequence, to the cylinders 17 through 20. Electronic spark timing and fuel injection distributors such as the distributors 23 and 24 are well known. These distributors essentially comprise an electronic sequential gating of spark timing or fuel injection signals to appropriate cylinders without the use of a rotating mechanical switch, such as the rotating mechanical distributor member in prior engine control systems. In such prior systems, essentially a switch arm is rotated in synchronization with engine rotation so that a developed spark timing or fuel control signal for cylinder 1 is only channeled to cylinder 1. In the present "distributorless" ignition system, the channeling of the spark timing and/or fuel injection control signals is accomplished electronically, and for this reason it is necessary to determine not only the top-dead center position of each of the cylinders, but also to distinguish a first or reference cylinder top-dead center position from other cylinder top-dead center positions. In the present invention, the coincidence gate 21 distinguishes the occurrence of the cylinder 17 top-dead center position from the occurrence of each of the other cylinder top-dead center positions. This is accomplished without the use of any additional sensor element.

Within each of the spark distributor 23 and fuel distributor 24 there essentially exists a conventional multiplex circuit which channels received information to appropriate cylinders in a predetermined sequence. This multiplex circuit is essentially reset (synchronized) in response to the occurrence of a reference signal provided by the spark timing control 16 which corresponds to the occurrence of the No. 1 reference cylinder top-dead center cycle position. This signal is provided by the spark timing control 16 at a terminal 26. The signal at terminal 26 may also be coupled to the fuel injection control circuit 25 for use thereby. As will be explained in detail subsequently, normally the signal at the terminal 26 will correspond to the first reference signal at the terminal 22.

An advantage of the above-described position sensor assembly configuration is that while the spark timing control 16 will utilize a programmed microprocessor to determine when a sensor pulse is substantially longer than the 1 degree sensor pulses, determining the occurrence of the reference cylinder TDC position merely requires the utilization of the AND gate 21. Therefore, this reference cylinder determination does not unnecessarily and additionally burden the programmed microprocessor which is contemplated as being within the spark timing control 16. Some additional details of the spark timing control 16 will be discussed subsequently As indicated in FIG. 1, each of the sensor output terminals A and B is coupled to a switch 27 which provides an output at a terminal 28 that is connected as an input to both the spark timing control 16 and the fuel injection control circuit 25. Essentially, the signal at the terminal 28 comprises either the signal A at the terminal A or the signal B at the terminal B depending upon whether or not a fault detector 29 has determined that a fault exists in the signal at the terminal A. In the absence of a fault, the signal A is provided at terminal 28. The operation of the fault detector 29 will now be discussed with reference to the specific embodiment of this component shown in FIG. 4 and the waveforms shown in FIG. 5 which illustrate how this embodiment operates.

The fault detector 29 comprises a conventional D-type flip-flop 30 whose clock terminal is directly connected to the output terminal A and whose data terminal D is connected to ground. The clear terminal CLR of the flip-flop 30 is connected to a logic 1 high state H, and the set terminal SET of the flip-flop receives its input from a terminal C. The output terminal B is connected as an input to a one-shot monostable multivibrator 31 which provides an output at the terminal C. The terminal B is also connected to the clock terminal of a flip-flop 31 whose data terminal D is connected to a Q1 output terminal of flip-flop 30. The clear and set terminals of the flip-flop 31 are connected to a logic 1 high state H, and the flip-flop 31 provides an output Q2 at an output terminal 32.

Figure 4:
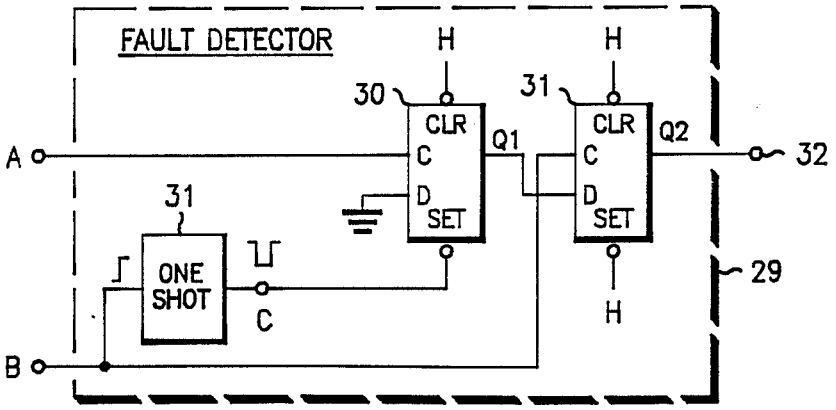
FIG. 4 comprises a schematic diagram illustrating a typical embodiment for a fault detector shown in FIG. 1.
Figure 5:
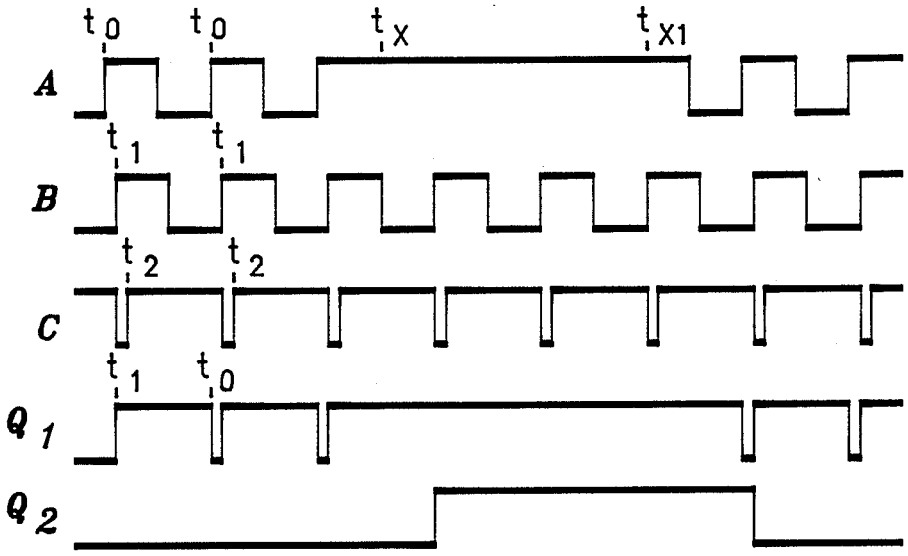
FIG. 5 comprises a series of graphs illustrating signal waveforms produced by the fault detector in FIG. 4.

The operation of the fault detector 29 will now be discussed with reference to the circuit in FIG. 4 and the waveforms shown in FIG. 5. The signal at the terminal A comprises a series of repetitive pulses with the first such pulse commencing at a time $t_0$. The signal at the terminal B essentially comprises an identical pulse stream which is just delayed from the signal at terminal A by the 5 degree angular width spacing d between the sensing elements 13 and 14. Thus the pulses shown in FIG. 5 for the signal at the terminal B will normally commence at times $t_1$ subsequent to $t_0$. The time delay between $t_0$ and $t_1$ is related to the angular rotational speed of wheel 11 and the spacing d.

In response to each rising edge of pulses at the terminal B, a short-duration negative pulse is provided at the terminal C which terminates at a subsequent time $t_2$. With the configuration shown for the detector 29 in FIG. 4, this results in the output $Q_1$ having the signal waveform shown in FIG. 5 wherein Q1 has a high logic state from substantially $t_1$ until flip-flop 30 is clocked low by the rising edge of the signal A at $t_0$. The flip-flop 30 is then set high by the next occurrence of a low logic state for the signal at the terminal C which occurs substantially at $t_1$. This results in Q2 normally having a constant low logic state since the clocking of the flip-flop 31 will occur at the rising edge of the signal at terminal B (at $t_1$), and at this time the output $Q_1$ will be low. It is understood, of course, that this occurs because the monostable 31 has a small, but finite response time such that the clocking of the flip-flop 31 will occur slightly before the signal at the terminal C can set the flip-flop 30 to a high state. The end result is that a low logic state is provided at the terminal 32 as long as expected pulses are being provided at both of the terminals A and B.

If, for some reason such as a failure of the sensor element 14, after a time $t_x$ no pulse changes are provided at the terminal A, then the output Q2 will be set high and remain there for so long as this condition exists. This is illustrated in FIG. 5 by a constant high state existing for signal A between times $t_x$ and $t_{x1}$. It should be noted that while in FIG. 5 a fault in the signal A was illustrated as a constant high level logic state, at least during the times $t_x$ through $t_{x1}$, a constant low logic state during this time would also produce an equivalent result. Thus, when the fault detector 29 determines that a fault exists resulting in the absence of signal transitions at the terminal A, a high logic level will be produced at the terminal 32 indicative of such a fault condition. In response to such an event, the switch 27, which previously provided the signal at the terminal A to the terminal 28 for utilization by the spark timing control 16 and fuel injection control circuit 25, will now provide the duplicate, but slightly delayed, sensor signal B at the terminal B for use by the spark timing and fuel control circuits 16 and 25. This is accomplished in the following manner.

Figure 6:
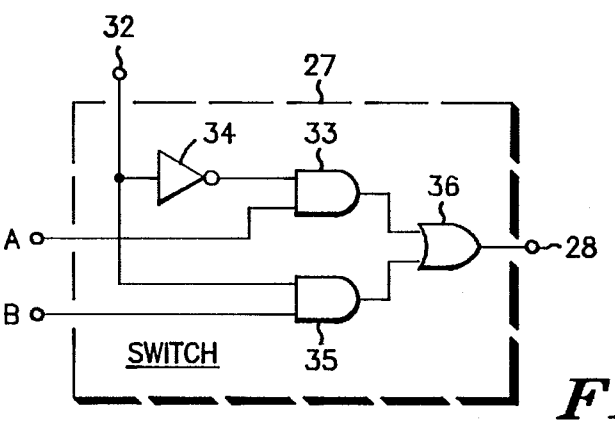
FIG. 6 comprises a schematic diagram illustrating a typical embodiment of a switch shown in FIG. 1.

Referring to FIG. 6, an embodiment of the switch 27 is illustrated. The terminal A is connected as an input to an AND gate 33 which receives another input via an inverter 34 connected between the terminal 32 and the AND gate 33. The terminal B is connected as an input to an AND gate 35 that receives another input by virtue of a direct connection to the terminal 32. The outputs of the AND gates 33 and 35 are connected to an OR gate 36 which provides, as its output, a signal at the terminal 28. This configuration results in the switch 27 normally passing the signal A to the terminal 28 unless the fault detector 29 has determined that there is a fault related to the signal A at the terminal A. In such an event, a high logic signal will be provided at the terminal 32 resulting in the switch 27 now passing the signal at the terminal B to the terminal 28 instead of the signal at the terminal A. Thus, for a detected fault, the switch 27 will cause the duplicate but slightly delayed engine position signal at the terminal B to be utilized by the spark timing control and the fuel injection control circuit rather than the faulty signal at the terminal A. This is accomplished with a minimum of additional circuitry and provides for the continued reliable operation of the engine control system 10 despite the fact that a fault has now been detected which results in loss of the engine position information normally provided by the signal at the terminal A. Note that if the fault disappears, normal operation will resume.

For either a constant low or high logic state fault for signal A, the detected fault, indicative of a loss of signal transition information at the terminal A, will also impair the reliability of the reference cylinder top-dead center identification signal produced at the terminal 22. It is for this reason that the fault detection signal at the terminal 32 is also connected as an input to the spark timing control 16. This is because it is contemplated that the spark timing control 16 will include therein a substitute reference pulse circuit 40 (or computer program) which, in response to a detected fault, will produce a substitute reference cylinder top-dead center identification signal at terminal 26 rather than providing the signal at the terminal 22 as its output. This is accomplished in the following manner.

Figure 7:
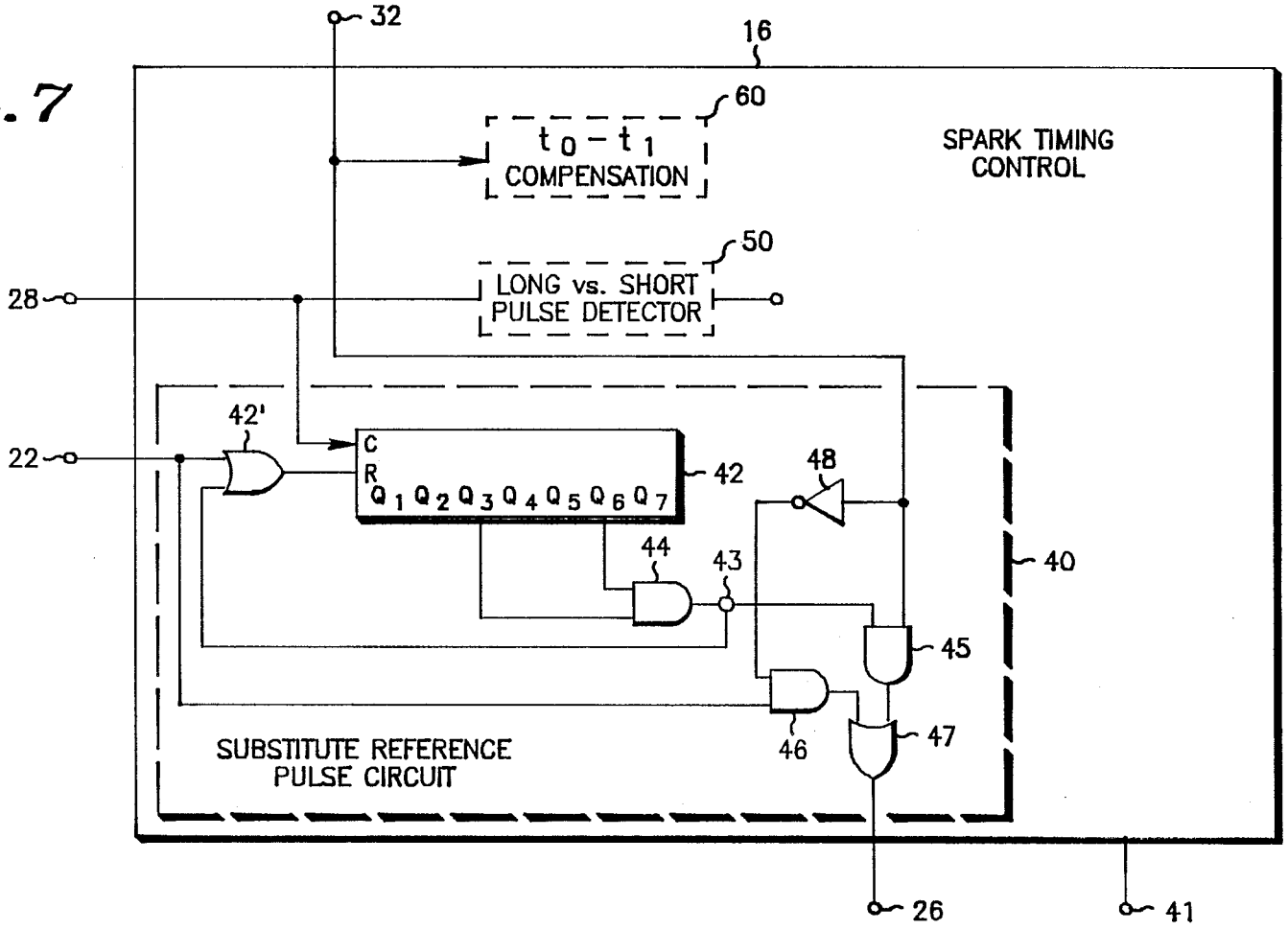
FIG. 7 comprises a schematic diagram illustrating some of the internal construction of a spark timing control device shown in FIG. 1.

FIG. 7 illustrates a preferred embodiment for the spark timing control 16. As indicated previously, the main function of the control 16 is to receive high resolution engine position signals (A or B) provided at the terminal 28 and produce suitable spark timing occurrence control signals. These controls signals are provided at an output terminal 41 which is connected as an input to the electronic spark distributor 23 that presents these signals, in an appropriate sequential manner, to each of the engine cylinders 17 through 20. With regard to this general overall function of the spark timing control 16, such a function can be implemented by numerous well-known prior art circuits.

According to the present invention, the spark timing control 16 includes a substitute reference pulse circuit 40 which is similar in operation to the reference pulse verification circuit shown in U.S. Pat. No. 4,553,426 to Capurka, which is assigned to the same assignee as the present invention. The substitute reference pulse circuit 40 essentially comprises a counter 42 which counts the pulses produced at the terminal 28 and will generate an output reset pulse at a predetermined count which corresponds to the predetermined number of pulses (corresponding to slots a and b) which exist between each occurrence of the reference cylinder identification top-dead center slot c. For the embodiment of the rotating wheel 11 shown in FIG. 2, 35 pulses exist between the sequential occurrence of the slot c passing by the sensing elements 13 and 14. Thus, for every 36 pulses produced at either the terminal A or B, you are sure that one reference cylinder identification top-dead center position will occur. The only problem is determining when to synchronize the counter 42. For the embodiment of the spark timing control 16 shown in FIG. 7, this occurs by having the reset terminal R of the counter 42 receive its input from an OR gate 42' that has terminal 22 connected as one input and receives another input from a terminal 43 that corresponds to the output of an AND gate 44 that produces an output when the counter 42 has a count of 36. A configuration of AND gates 45 and 46, an OR gate 47 and an inverter 48 essentially acts similar to switch 27 such that in the event that no fault is detected, the more reliable output of the coincidence gate 21 at the terminal 22 is directly utilized as the reference cylinder identification signal at terminal 26. If a fault is detected, then the substitute reference pulse signal produced at the terminal 43 is provided at terminal 26 and utilized. Whichever signal is utilized to determine the signal at the terminal 26, that signal will control (synchronize) the electronic spark distributor 23 and electronic fuel injection distributor 24.

In addition, FIG. 7 illustrates the spark timing control circuit 16 as including a long versus short pulse detector 50 which, as generally indicated previously, will receive the signal at the terminal 28 and distinguish the top-dead center longer pulses attributable to the slots b or c, from the shorter duration pulses attributable to the slots a. As indicated previously, this can readily be implemented by utilizing the techniques discussed in the Hunninghaus et al. U.S. Pat. No. 4,628,269. Preferably this function will be implemented by a programmed computer which will distinguish between receiving a signal pulse having a predetermined longer duration, by a factor of at least 1.5, than preceding and subsequent received signal pulses. The top-dead center reference information produced by the circuit 50 can be utilized by the spark timing control 16 itself. This TDC information can also be provided to the electronic spark distributor 23 and fuel distributor 24 so as to increment multiplexing circuits in these circuits so as to provide sequential gating of the spark timing and fuel injection control signals provided to the distributors 23 and 24 to the next engine cylinder. It should be remembered that these multiplexing circuits are initialized (synchronized) by the reference cylinder identification signal CID provided at terminal 26.

One additional feature of the present invention concerns providing, in the spark timing control 16 shown in FIG. 7, a compensation circuit 60 which receives the fault signal at the terminal 32, and, in response thereto, produces compensation for the spark timing control 16 in accordance with the angular difference between times $t_0$ to $t_1$. In response to a detected fault, the spark timing control 16 will now receive at terminal 28 the signal B at terminal B, rather than the signal A at terminal A, due to switch 27. It will be remembered that there is a fixed angular difference d between the signals A and B corresponding to the 5 degree angular spacing between the sensing elements 13 and 14. Normally, the spark timing control 16 will receive the signal A provided at the terminal A. However, in the event that a fault occurs for the signal A at the terminal A, and this fault is detected by the fault detector 29, then the spark timing control 16 will now receive and utilize the signal at the terminal B due to the action of the switch 27. However, in order to maintain precise spark timing control, the operation of the spark timing control 16 may have to be somewhat modified to take into account that now the signal at the terminal 28 will be somewhat delayed because now this signal will correspond to the signal at the terminal B.

The compensation circuit 60 essentially is representative of a circuit which implements a minor modification to the general spark timing control operation of the control 16. The spark control 16 can comprise a circuit such as the circuit in U.S. Pat. No. 4,168,682 to Gartner, U.S. Pat. No. 4,231,332 to Wrathall or U.S. Pat. No. 4,241,708 to Javeri. In these patents, and other similar spark controllers, it is clear that minor adjustments to spark timing can be implemented by essentially adjusting the switching threshold of a comparison circuit. Thus, all that the compensation circuit 60 will implement is an adjustment of a comparison circuit internal to the spark timing control 16 so as to take into account that now the input signal at the terminal 28 will be delayed by 5 angular degrees, from the previously-received spark timing signal at the terminal 28. This correction may not always be necessary, and, in fact, it is believed that such a change in the operation of the spark timing control 16 may not substantially affect engine performance.

While I have shown and described specific embodiments of the present invention, further modifications and improvements will occur to those skilled in the art. Such modifications could comprise using the present invention for control of the operation of a motor other than a fuel combustion engine, or implementing the coincidence function of AND gate 21 by a a programmed microprocessor. All such modifications which retain the basic underlying principles disclosed and claimed herein are within the scope of this invention.

I claim:

1. An electronic position sensor assembly comprising:

a wheel rotatably driven about an axis, said wheel having thereon a plurality of predetermined portions of at least three different angular widths a, b and c, angular width a being less than angular width b which is less than angular width c;

a sensor means positioned fixed with respect to and adjacent said wheel, said sensor means having at least first and second sensing elements each independently sensing the passage of each of said predetermined portions by the sensing element and producing in response thereto a signal pulse having a duration corresponding to the angular width of said sensed predetermined portion;

said first and second sensing elements spaced apart by a dimension d corresponding to an angular width which is less than angular width c but more than angular width a and more than angular width b;

coincidence means for providing a first reference signal in response to said first and second sensing elements simultaneously producing predetermined logic state conditions of said sensor signal pulses; and means for providing a second reference signal, different from said first reference signal, in response to one of sensing elements producing a signal pulse having a predetermined longer duration than the preceding signal pulse produced by that sensing element, whereby information as to the angular position of said wheel is obtained by at least said first and second reference signals.

2. An electronic position sensor assembly according to claim 1 wherein said second reference signal means comprises a computer programmed to distinguish between receiving a signal pulse having a predetermined longer duration than a preceding received signal pulse.

3. An electronic position sensor assembly according to claim 2 wherein said predetermined longer duration comprises at least 1.5 times the duration of said preceding received signal pulse.

4. An electronic position sensor assembly according to claim 1 wherein said predetermined portions are uniformly positioned about said wheel with leading edges thereof, with respect to said sensing elements, being spaced apart by an angular width e which is larger than said angular width d.

5. An electronic position sensor assembly according to claim 1 wherein said predetermined portions are arranged on said wheel such that each of said predetermined portions having an angular width of b or c is spaced apart from another of said predetermined portions having an angular width of b or co by a plurality of said predetermined portions each having an angular width a.

6. An electronic position sensor assembly according to claim 5 wherein said sensing elements comprise optical sensing elements which are mounted adjacent to each other in a unitary sensor housing and wherein said predetermined portions comprise slots in said wheel, said slots defining a circular sensing track on said wheel for said sensing elements.

7. An electronic position sensor assembly according to claim 6 wherein said sensing elements are fixed with respect to each other

8. An electronic position sensor assembly according to claim 5 wherein a plurality of said predetermined portions have said angular width b.

9. An electronic position sensor assembly according to claim 8 wherein said sensing elements and predetermined portions are configured such that said signal pulses provided by said second sensing element in response to said predetermined portions typically comprise said signal pulses provided by said first sensing element except having a time delay related to rotational speed of said wheel and said angular width d.

10. An electronic position sensor assembly according to claim 9 wherein each of said predetermined portions effectively has a single straight radial leading edge with respect to said wheel axis of rotation with both of said first and second sensing elements sensing said radial leading edge.

11. An electronic engine control system which utilizes an improved engine position sensor assembly, comprising:

a wheel rotatably driven about an axis by a multiple cylinder engine, said wheel having thereon a plurality of predetermined portions of at least three different angular widths a, b and c, angular width a being less than angular width b which is less than angular width c;

a sensor means positioned fixed with respect to and adjacent said wheel, said sensor means having at least first and second sensing elements each independently sensing the passage of each of said predetermined portions by the sensing element and producing in response thereto a signal pulse having a duration corresponding to the angular width of said sensed predetermined portion;

said first and second sensing elements spaced apart by a dimension d corresponding to an angular width which is less than angular width c but more than width a and more than angular width b;

coincidence means for providing a first reference signal in response to said first and second sensing elements simultaneously producing predetermined logic state conditions of said sensor signal pulses;

means for providing a second reference signal, different from said first reference signal, in response to one of sensing elements producing a signal pulse having a predetermined longer duration than the preceding signal pulse produced by that sensing element; and engine control means for utilizing said signal pulses from at least one of said first and second sensing elements and at least one of said first and second reference signals to control fuel combustion in the cylinders of said engine.

12. An electronic engine control system according to claim 11 wherein said engine control means controls at least one combustion control parameter selected from a group of control parameters consisting of a parameter for controlling the providing of fuel into said engine cylinders and a parameter for controlling the time occurrence of combustion of fuel in said engine cylinders.

13. An electronic engine control system according to claim 11 which includes means for determining a fault in one of said first and second sensing elements.

14. An electronic engine control system according to claim 13 which includes switch means for, in response to said fault means determining a fault in said one of said first and second sensing elements, causing said engine control means to utilize the signal pulses provided by said other of said sensing elements rather than said signal pulses provided by said one sensing element.

15. An electronic engine control system according to claim 14 wherein said sensing elements and said predetermined portions are configured such that said signal pulses provided by said second sensing element typically, in the absence of a fault, comprise said signal pulses provided by said first sensing element except delayed in time occurrence by a time related to the rotational speed of said wheel and said angular width d.

16. An electronic engine control system according to claim 15 which includes compensation means for, in response to the fault means determining a fault in said one of said first and second sensing elements, effectively adjusting the operation of at least one of said switch means and said engine control means so as to effectively adjust the operation of said engine control means in accordance with the different time occurrence relationship that normally exists between pulses provided by said first and second sensing elements, said adjustment being related to said angular width d.

17. An electronic engine control system according to claim 11 wherein said engine control means includes fuel injection means for controlling the injection of fuel into said cylinders.

18. An electronic engine control system according to claim 17 which includes electronic fuel injector distributor means for sequentially delivering fuel injection signals developed by said fuel injection means to different engine cylinders in accordance with at least said second reference signal.

19. An electronic engine control system according to claim 11 wherein said engine control means includes spark timing means for controlling the time occurrence of fuel combustion in said cylinders.

20. An electronic engine control system according to claim 19 which includes electronic spark distributor means for sequentially delivering spark timing signals provided by said spark timing means to different engine cylinders in a predetermined sequence in accordance with at least said second reference signal.

21. An electronic engine control system according to claim 20 wherein said engine control means includes fuel injection means for controlling the injection of fuel into said cylinders.

22. An electronic engine control system according to claim 21 which includes electronic fuel injector distributor means for sequentially delivering fuel injection signals developed by said fuel injection means to different engine cylinders in accordance with at least said second reference signal.

23. An electronic motor control system comprising:

means for sensing the position of a body rotated by a motor and including two independent sensing elements each of which independently senses the rotational position of said body and provides a separate, independent position signal, comprising signal pulses, related to the angular position of said body;

means for receiving each of said position sensor signals and providing a first reference signal pulse in response to the simultaneous time occurrence of predetermined logic state conditions of said position signals, said first reference signal pulse indicative of the occurrence of a predetermined rotational position of said body;

means for controlling operation of said motor in accordance with said reference signal and at least one of said position signals;

means for detecting a fault in said one of said position signals; and means, in response to said fault detection, for selecting the other of said position signals, instead of said one position signal, for utilization by said motor control means.

24. An electronic motor control system according to claim 23 wherein one of said separate independent position signals, in the absence of a fault, comprises the other of said separate independent position signals except delayed in time occurrence by an amount related to the rotational speed of said body.

25. An electronic motor control system according to claim 24 wherein said two sensing elements are spaced apart by a predetermined angular width which determines said amount of delay.

26. An electronic motor control system according to claim 25 wherein said body has a plurality of predetermined portions sensed by both of said sensing elements, at least one of said predetermined portions having an angular width c greater than said angular width between said sensing elements so as to provide said first reference signal pulse when said one of said predetermined portions is simultaneously sensed by said two sensing elements.

27. An electronic motor control system comprising:

means for sensing the position of a body rotated by a motor and including two independent sensing elements each of which independently senses the rotational position of said body and provides a separate, independent position signal related to the angular position of said body;

means for receiving each of said position sensor signals and providing a first reference signal in response to the simultaneous time occurrence of predetermined logic state conditions of said position signals;

means for controlling operation of said motor in accordance with said reference signal and at least one of said position signals;

means for detecting a fault in said one of said position signals; and means, in response to said fault detection, for providing a substitute reference signal to said motor control means for utilization rather than said reference signal.

28. An electronic motor control system according to claim 27 wherein said substitute reference signal providing means includes means for counting, in the event of a fault of said one position signal, said signal pulses provided by the other of said position signal, and providing said substitute reference signal in response to said count exceeding a predetermined amount.

29. An electronic motor control system according to claim 28 which includes means, in response to said fault detection, for selecting the other of said position signals, instead of said one position signal, for utilization by said motor control means.

30. An electronic motor control system according to claim 29 wherein one of said separate independent position signals, in the absence of a fault, comprises the other of said separate independent position signals except delayed in time occurrence by an amount related to the rotational speed of said body.

31. An electronic motor control system according to claim 30 wherein said two sensing elements are spaced apart by a predetermined angular width which determines said amount of delay.

32. An electronic motor control system according to claim 27 wherein said motor comprises a fuel combustion engine and wherein said motor control means controls fuel consumption of said engine in accordance with said reference and position signals.

33. A high resolution electronic position sensor assembly comprising:

a wheel rotatably driven about an axis, said wheel having thereon at least one predetermined portion having an angular width c and a plurality of predetermined portions having other angular widths less than angular width c;

a sensor means positioned fixed with respect to and adjacent said wheel, said sensor means having at least first and second sensing elements each independently sensing the passage of each of said predetermined portions by the sensing element and producing in response thereto an associated signal having a signal pulse having a duration corresponding to the angular width of said sensed predetermined portion;

said first and second sensing elements spaced apart by a dimension d corresponding to an angular width which is less than angular width c but more than said other angular widths; and coincidence means for providing a first reference signal in response to said first and second sensing elements simultaneously producing predetermined logic state conditions of said signal pulses, wherein there are at least 36 of all of said predetermined portions, all of said predetermined portions being uniformly positioned about said wheel with leading edges thereof, with respect to said sensing elements, being spaced apart by an angular width e which is larger than said angular width d.

34. An electronic position sensor assembly according to claim 33 wherein said sensing elements comprise optical sensing elements which are mounted adjacent to each other in a unitary sensor housing and wherein said predetermined portions comprise slots in said wheel, said slots defining a circular sensing track on said wheel for said sensing elements.

35. An electronic position sensor assembly according to claim 34 wherein said sensing elements are fixed with respect to each other.

36. An electronic position sensor assembly according to claim 35 wherein said sensing elements and predetermined portions are configured such that said signal pulses provided by said second sensing element in response to said predetermined portions typically comprise said signal pulses provided by said first sensing element except having a time delay related to rotational speed of said wheel and said angular width d.

37. An electronic position sensor assembly according to claim 36 wherein each of said predetermined portions effectively has a single straight radial leading edge with respect to said wheel axis of rotation with both of said first and second sensing elements sensing said radial leading edge.

38. An electronic engine control system which utilizes an improved engine position sensor assembly, comprising:

a wheel rotatably driven about an axis by an engine having a plurality of cylinders, said wheel having thereon at least one predetermined portion having an angular width c and a plurality of predetermined portions of other angular widths less than angular width c;

a sensor means positioned fixed with respect to and adjacent said wheel, said sensor means having at least first and second sensing elements each independently sensing the passage of each of said predetermined portions by the sensing element and producing in response thereto an associated signal having signal pulses having a duration corresponding to the angular width of said sensed predetermined portion;

said first and second sensing elements spaced apart by a dimension d corresponding to an angular width which is less than angular width c but more than said other angular widths;

coincidence means for providing a first reference signal in response to said first and second sensing elements simultaneously producing predetermined logic state conditions of said signal pulses, and engine control means for utilizing said signal pulses from at least one of said first and second sensing elements and at least said reference signal to control fuel combustion in the cylinders of said engine, wherein the number of said predetermined portions having angular widths less than angular width c is substantially more than the number of engine cylinders.

39. An electronic engine control system according to claim 38 wherein all of said predetermined portions are uniformly positioned about said wheel with leading edges thereof, with respect to said sensing elements, being spaced apart by an angular width e which is larger than said angular width d, and wherein said sensing elements comprise optical sensing elements which are mounted adjacent to each other in a unitary housing and wherein said predetermined portions comprise slots in said wheel, said slots defining a circular sensing track on said wheel for said sensing elements.

40. An electronic engine control system according to claim 39 which includes means for determining a fault in one of said first and second sending elements.

41. An electronic engine control system according to claim 40 which includes switch means for, in response to said fault means determining a fault in said one of said first and second sensing elements, causing said engine control means to utilize the signal pulses provided by said other of said sensing elements rather than said signal pulses provided by said one sensing element.

42. An electronic engine control system according to claim 41 wherein said sensing elements and said predetermined portions are configured such that said signal pulses provided by said second sensing element typically, in the absence of a fault, comprise said signal pulses provided by said first sensing element except delayed in time occurrence by a time related to the rotational speed of said wheel and said angular width d.

43. An electronic engine control system according to claim 42 wherein said engine control means includes fuel injection means for controlling the injection of fuel into said cylinders, and which includes electronic fuel injector distributor means for sequentially delivering fuel injection signals developed by said fuel injection means to different engines cylinders.

44. An electronic engine control system according to claim 43 wherein said engine control means includes spark timing means for controlling the time occurrence of fuel combustion in said cylinders, and which includes electronic spark distributor means for sequentially delivering spark timing signals provided by said spark timing means to different engine cylinders in a predetermined sequence.

45. An electronic position sensor assembly comprising:

a wheel rotatably driven about an axis, said wheel having thereon a plurality of predetermined portions of at least three different angular widths a, b and c, angular width a being less than angular width b which is less than angular width c;

a sensor means positioned fixed with respect to and adjacent said wheel, said sensor means having at least first and second sending elements each independently sensing the passage of each of said predetermined portions by the sensing element and producing in response thereto a signal having signal pulses corresponding to and occurring during the angular width of said sensed predetermined portion;

said first and second sensing elements spaced apart by a dimension d corresponding to an angular width which is less than angular width c but more than angular width a and more than angular width b;

coincidence means for providing a first reference signal, indicative of the passage of said predetermined portion of width c by the sensor means, in response to said first and second sensing elements simultaneously producing predetermined logic state conditions of said sensor signal pulses; and means for receiving said sensor signal pulses provided by at least one of said first and second sensing elements and providing in response thereto a second reference signal, different from said first reference signal, indicative of the passage of each said predetermined portions of width b by the sensor means, whereby information as to the angular position of said wheel is obtained by at least said first and second reference signals.

46. An electronic position sensor assembly according to claim 45 wherein said predetermined portions are uniformly positioned about said wheel with at least one edge thereof, with respect to said sensing elements, being spaced apart by an angular width e which is larger than said angular width d.

47. An electronic position sensor assembly according to claim 45 wherein said predetermined portions are arranged on said wheel such that each of said predetermined portions having an angular width of b or c spaced apart from another of said predetermined portions having an angular width of b or c by a plurality of said predetermined portions each having an angular width a.

48. An electronic position sensor assembly according to claim 47 wherein said sensing elements comprise optical sensing elements which are mounted adjacent to each other in a unitary sensor housing and wherein said predetermined portions comprise slots in said wheel, said slots defining a circular sensing track on said wheel for said sensing elements.

49. An electronic position sensor assembly according to claim 48 wherein said sensing elements and predetermined portions are configured such that said signal pulses provided by said second sensing element in response to said predetermined portions typically comprise said signal pulses provided by said first sensing element except having a time delay related to rotational speed of said wheel and said angular width d.

50. An electronic engine control system which utilizes an improved engine position sensor assembly, comprising:

a wheel rotatably driven about an axis by a multiple cylinder engine, said wheel having thereon a plurality of predetermined portions of at least three different angular widths a, b and c, angular width a being less than angular width b which is less than angular width c;

a sensor means positioned fixed with respect to and adjacent said wheel, said sensor means having at least first and second sensing elements each independently sensing the passage of each of said predetermined portions by the sensing element and producing in response thereto a signal having signal pulses corresponding to and occurring during the angular width of said sensed predetermined portion;

said first and second sensing elements spaced apart by a dimension d corresponding to an angular width which is less than angular with c but more than angular width a and more than angular width b;

coincidence means for providing a first reference signal, indicative of the passage of said predetermined portion of width c by the sensor means, in response to said first and second sensing elements simultaneously producing predetermined logic state conditions of said sensor signal pulses;

means for receiving said sensor signal pulses provided by at least one of said first and second sensing elements and providing in response thereto a second reference signal, different from said first reference signal, indicative of the passage of each said predetermined portions of width b by the sensor means, whereby information as to the angular position of said wheel is obtained by at least said first and second reference signals; and engine control means for utilizing said signal pulses from at least one of said first and second sensing elements and at least one of said first and second reference signals to control fuel combustion in the cylinders of said engine.

51. An electronic engine control system according to claim 50 wherein said engine control means includes means for controlling at least one combustion control parameter selected from a group of control parameters consisting of a parameter for controlling the providing of fuel into said engine cylinders and a parameter for controlling the time occurrence of combustion of fuel in said engine cylinders, and which includes electronic distributor means for sequentially delivering signals provided by said engine control means for control of said one combustion control parameter to different engine cylinders in a predetermined sequence in accordance with at least said second reference signal.

52. An electronic engine control system according to claim 50 which includes means for determining a fault in one of said first and second sensing elements.

53. An electronic engine control system according to claim 52 which includes switch means for, in response to said fault means determining a fault in said one of said first and second sensing elements, causing said engine control means to utilize the signal pulses provided by said other of said sensing elements rather than said signal pulses provided by said one sensing element.

54. An electronic engine control system according to claim 50 wherein said sensing elements and said predetermined portions are configured such that said signal pulses provided by said second sensing element typically, in the absence of a fault, comprise said signal pulses provided by said first sensing element except delayed in time occurrence by a time related to the rotational speed of said wheel and said angular width d.

55. An electronic engine control system which utilizes an improved engine position sensor assembly, comprising:

a wheel rotatably driven about an axis by an engine having a plurality of cylinders, said wheel having thereon at least one predetermined portion having an angular width c and a plurality of predetermined portions of other angular widths less than angular width c;

a sensor means positioned fixed with respect to and adjacent said wheel, said sensor means having at least first and second sensing elements each independently sensing the passage of each of said predetermined portions by the sensing element and producing in response thereto an associated signal having signal pulses corresponding to and occurring during the angular width of said sensed predetermined portion;

said first and second sensing elements spaced apart by a dimension d corresponding to an angular width which is less than angular width c but more than said other angular widths;

coincidence means for providing a first reference signal, indicative of the passage of said predetermined portion of width c by the sensor means, in response to said first and second sensing elements simultaneously producing predetermined logic state conditions of said sensor signal pulses; and engine control means for utilizing said signal pulses from at least one of said first and second sensing elements and at least said reference signal to control fuel combustion in the cylinders of said engine, wherein the number of said predetermined portions having angular widths less than angular width c is substantially more than the number of engine cylinders.

56. An electronic engine control system according to claim 55 wherein said sensing elements and said predetermined portions are configured such that said signal pulses provided by said second sensing element typically, in the absence of a fault, comprise said signal pulses provided by said first sensing element except delayed in time occurrence by a time related to the rotational speed of said wheel and said angular width d.

57. An electronic engine control system according to claim 55 wherein all of said predetermined portions are uniformly positioned about said wheel with at least one edge thereof, with respect to said sensing elements, being spaced apart by an angular width e which is larger than said angular width d.

58. An electronic engine control system according to claim 57 wherein said sensing elements comprise optical sensing elements which are mounted adjacent to each other in a unitary housing and wherein said predetermined portions comprise slots in said wheel, said slots defining a circular sensing track on said wheel for said sensing elements.

59. An electronic engine control system according to claim 55 which includes means for determining a fault in one of said first and second sensing elements, and which includes switch means for, in response to said fault means determining a fault in said one of said first and second sensing elements, causing said engine control means to utilize the signal pulses provided by said other of said sensing elements rather than said signal pulses provided by said one sensing element.

60. An electronic engine control system according to claim 55 wherein said engine control means includes means for controlling at least one of the parameters of injection of fuel into said cylinders and time occurrence of fuel combustion in said cylinders, and which includes electronic distributor means for sequentially delivering signals developed by said control means for controlling said one parameter to different engine cylinders in accordance with said sensor signal pulses.

61. An electronic engine control system which utilizes an improved engine position sensor assembly, comprising:

a wheel rotatably driven about an axis by an engine having a plurality of cylinders, said wheel having thereon at least one predetermined portion having an angular width c and a plurality of predetermined portions of other angular widths less than angular width c spaced about said axis with an angular spacing e between corresponding edges of said plurality of predetermined portions;

a sensor means positioned fixed with respect to and adjacent said wheel, said sensor means having at least first and second sensing elements each independently sensing the passage of each of said predetermined portions by the sensing element and producing in response thereto an associated signal having signal pulses corresponding to and occurring during the angular width of said sensed predetermined portion;

said first and second sensing elements spaced apart by a dimension d corresponding to an angular width which is less than angular spacing e but more than said other angular widths of said predetermined portions which are less than angular width c;

coincidence means for providing a first reference signal, indicative of the passage of said predetermined portion of width c by the sensor means, in response to said first and second sensing elements simultaneously producing predetermined logic state conditions of said sensor signal pulses; and engine control means for utilizing said signal pulses from at least one of said first and second sensing elements and at least said reference signal to control fuel combustion in the cylinders of said engine, wherein the number of said predetermined portions having angular widths less than angular width c is substantially more than the number of engine cylinders.

* * * * *